US012504226B2

(12) United States Patent
Tran et al.

(10) Patent No.: US 12,504,226 B2
(45) Date of Patent: Dec. 23, 2025

(54) METHOD AND APPARATUS FOR LIQUEFYING A $CO_2$-RICH GAS

(71) Applicant: L'Air Liquide, Societe Anonyme pour l'Etude et l'Exploitation des Procedes Georges Claude, Paris (FR)

(72) Inventors: Michael Tran, Champigny sur Marne (FR); Ludovic Granados, Champigny sur Marne (FR); Mathieu Leclerc, Champigny sur Marne (FR); Guillaume Rodrigues, Champigny sur Marne (FR); Aurore Troptard, Champigny sur Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 311 days.

(21) Appl. No.: 18/280,052

(22) PCT Filed: Feb. 28, 2022

(86) PCT No.: PCT/EP2022/054998
§ 371 (c)(1),
(2) Date: Sep. 1, 2023

(87) PCT Pub. No.: WO2022/184646
PCT Pub. Date: Sep. 9, 2022

(65) Prior Publication Data

US 2024/0310117 A1 Sep. 19, 2024

(30) Foreign Application Priority Data

Mar. 4, 2021 (FR) ..... 2102132

(51) Int. Cl.
*F25J 3/00* (2006.01)
*F25J 3/02* (2006.01)

(52) U.S. Cl.
CPC ..... *F25J 3/0266* (2013.01); *F25J 2210/80* (2013.01); *F25J 2215/80* (2013.01); *F25J 2235/80* (2013.01); *F25J 2290/34* (2013.01)

(58) Field of Classification Search
CPC ..... F25J 3/08; F25J 3/0266; F25J 2235/80; F25J 2215/80; F25J 2210/80; F25J 2290/34
See application file for complete search history.

(56) References Cited

U.S. PATENT DOCUMENTS 5,927,103 A * 7/1999 Howard ..... F25J 3/08 62/928
5,974,829 A * 11/1999 Novak ..... F25J 3/0266 62/928

(Continued)

FOREIGN PATENT DOCUMENTS

| | | |
|---|---|---|
| FR | 2 995 985 | 3/2014 |
| FR | 3 088 416 | 5/2020 |
| WO | WO 2013 171 426 | 11/2013 |

OTHER PUBLICATIONS

International Search Report and Written Report for PCT/EP2022/054998, mailed Aug. 17, 2022.

(Continued)

*Primary Examiner* — Brian M King
(74) *Attorney, Agent, or Firm* — Justin K. Murray

(57) ABSTRACT

An apparatus for separation of a flow containing at least 95 mol % of carbon dioxide and also at least one impurity lighter than carbon dioxide by distillation comprises a heat exchanger (20), a distillation column (30), expansion means (V3), means for sending the flow to be cooled in the heat exchanger, means for sending the cooled flow to be separated in the distillation column, means for withdrawing at the bottom of the column a liquid flow containing at least 99 mol % of carbon dioxide, means for sending at least a portion (12) of the liquid flow to be cooled in the heat (Continued)

exchanger to form a subcooled liquid (3), means for sending at least a portion of the subcooled liquid to the expansion means to produce a two-phase flow, a phase separator (40) for separating the two-phase flow to form a gas and a liquid, means for sending at least a portion (14) of the liquid from the phase separator to be vaporized in the heat exchanger and means for taking a portion (4) of the liquid from the phase separator.

15 Claims, 3 Drawing Sheets

(56) References Cited

U.S. PATENT DOCUMENTS

| | | | | |
|---|---|---|---|---|
| 9,851,142 | B2 | 12/2017 | Darde et al. | |
| 2008/0156035 | A1 | 7/2008 | Aspelund et al. | |
| 2008/0196587 | A1* | 8/2008 | Ha | F25J 3/04533 203/99 |
| 2011/0023539 | A1* | 2/2011 | White | F25J 3/0252 62/619 |
| 2013/0036765 | A1* | 2/2013 | Renaud | F25J 3/0242 62/618 |
| 2014/0026612 | A1* | 1/2014 | Demolliens | F25J 3/0625 62/613 |
| 2017/0363351 | A1 | 12/2017 | Caillat et al. | |

OTHER PUBLICATIONS

French Search Report for FR 2 102 132, mailed Nov. 4, 2021.

Aspelund, et al., "Gas conditioning—The interface between CO2 capture and transport," Jun. 16, 2017, vol. 1, No. 3, Jun. 16, 2007, pp. 343-354.

* cited by examiner

[FIG. 1]
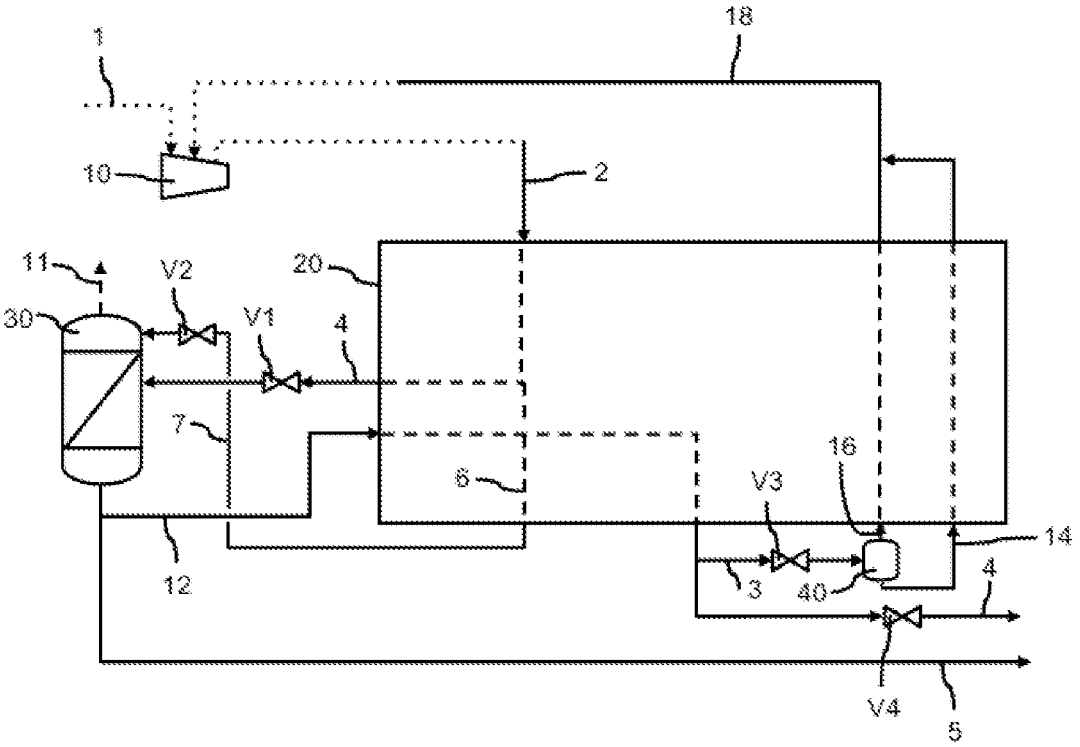

[FIG. 2]
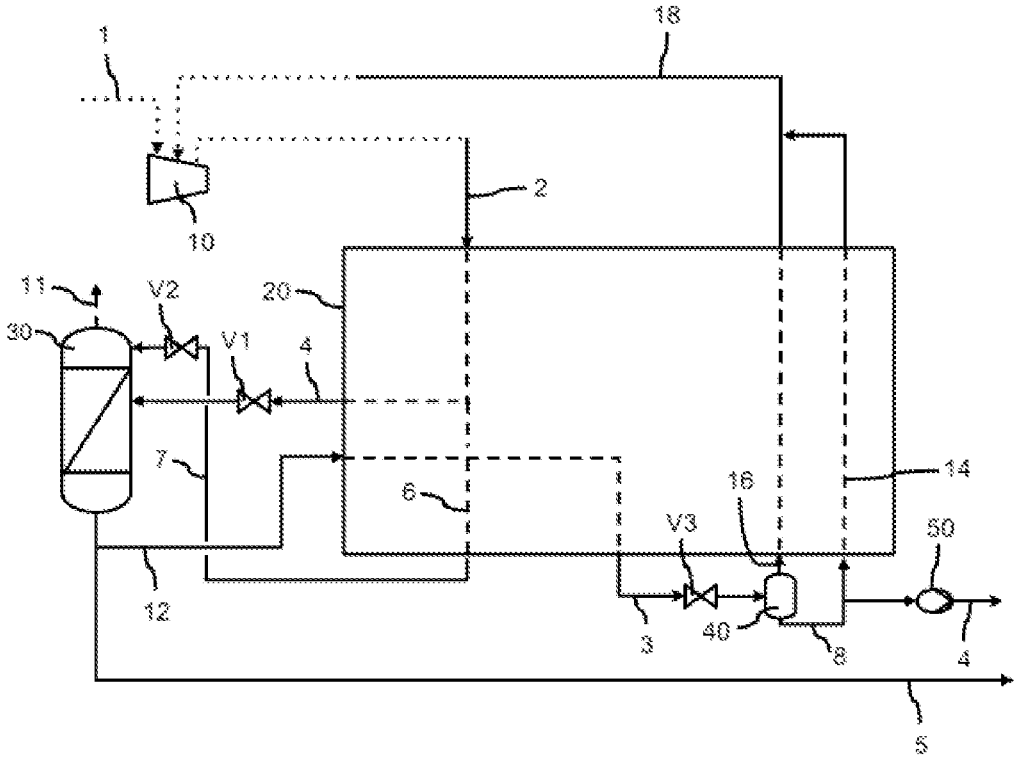

[FIG. 3]
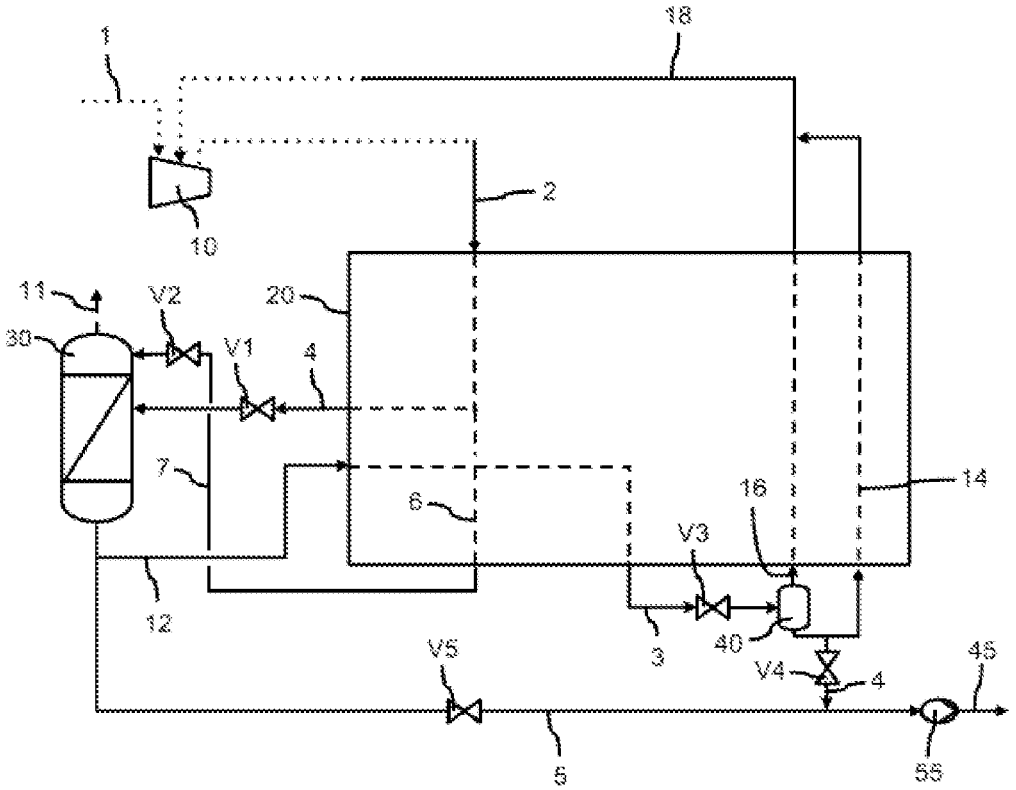

METHOD AND APPARATUS FOR LIQUEFYING A $CO_2$-RICH GAS

CROSS REFERENCE TO RELATED APPLICATIONS

This application is a § 371 of International PCT Application PCT/EP2022/054998, filed Feb. 28, 2022, which claims the benefit of FR2102132, filed Mar. 4, 2021, both of which are herein incorporated by reference in their entireties.

FIELD OF THE INVENTION

The present invention relates to a process and to an apparatus for the liquefaction of a gas rich in $CO_2$.

BACKGROUND OF THE INVENTION

In a process for the liquefaction of a gas rich in $CO_2$ (for example >95 mol % of carbon dioxide) composed for the remainder mainly of impurities ($O_2$, $N_2$, CO, for example), the pressurized $CO_2$ is liquefied and can be produced at a low pressure, but it is often desirable to produce the $CO_2$ also at a medium pressure within the same unit. The separating zone, exchanges and also the associated equipment would ideally be dimensioned so as to be able to adapt according to the demand.

FR2995985 describes a process in which a liquid from a distillation column of a mixture containing carbon dioxide In the $CO_2$ liquefaction processes usually described, the pressure of the product sent to the storage means is essentially a medium pressure of between 13 bara and 20 bara. This is a result of storage-related investment optimizations and of the availability of large-scale low-pressure storage technologies. Specifically, a medium pressure implies storing at temperatures between-20° C. and −35° C. In contrast, recent studies show a growing interest around the development of the low-pressure production chain (between 6 and 8 bara). This pressure level makes it possible to reduce the amount of material necessary for the manufacture of the storage means and hence to increase the volume of liquid $CO_2$ transported by sea. However, this implies storing the $CO_2$ at a lower temperature of between −46 and −52° C.

SUMMARY OF THE INVENTION

In certain embodiments, the present invention relates to a process for the liquefaction of $CO_2$-rich feed $CO_2$, involving the $CO_2$ itself in an open circuit or an external refrigeration cycle (ammonia or $CO_2$ for example). The exchange zone, which may be a brazed aluminum type exchanger, is dimensioned in such a way as to be able to produce liquid $CO_2$ at medium pressure and therefore at medium temperature, but also at low pressure and thus at low temperature.

An object of the invention is to optimize the heat exchanger of a liquefaction process in order to be able to subcool a product and a refrigeration cycle liquid in the same passage.

The invention also makes it possible to produce liquefied $CO_2$ at two different pressures.

According to one subject of the invention, there is provided a process for the separation of a flow containing at least 95 mol % of carbon dioxide and also at least one impurity lighter than carbon dioxide by distillation, wherein:

i) the flow is cooled in a heat exchanger and separated in a distillation column or by a partial condensation step in a separator vessel, ii) a liquid flow containing at least 99 mol % of carbon dioxide is withdrawn at the bottom of the column or vessel, iii) a portion of the liquid flow is sent to be cooled in the heat exchanger to form a subcooled liquid, iv) at least a portion of the subcooled liquid is expanded to produce a two-phase flow, v) the two-phase flow is separated to form a gas and a liquid and at least a portion of the liquid is sent to be heated in the heat exchanger by indirect heat exchange with at least a portion of the flow that is to be separated and with the at least a portion of the liquid that is to be subcooled, the at least a portion of the liquid vaporizing in the heat exchanger and vi)

a) a portion of the liquid from step v) is taken as first liquid product, optionally after pressurization in a pump or b) a portion of the subcooled liquid is taken as first liquid product vii) a second liquid product is produced by taking a portion of the bottom liquid from the column or vessel without cooling it in the heat exchanger and preferably without expanding it and viii) the first and second products are produced simultaneously.

According to other optional characteristics:

with variant a), wherein all of the subcooled liquid is expanded to produce the two-phase flow and a portion of the liquid from step v) is sent to be vaporized in the heat exchanger.

with variant b), wherein a portion of the subcooled liquid is expanded to produce the two-phase flow and all of the liquid from step v) is sent to be vaporized in the heat exchanger.

the gas from step v) is heated in the exchanger.

the liquid vaporized in the exchanger is sent to be mixed with the flow that is to be cooled upstream of the exchanger.

According to another aspect of the invention, there is provided a process for the separation of a flow containing at least 95 mol % of carbon dioxide and also at least one impurity lighter than carbon dioxide by distillation, wherein according to a first and a second mode of operation:

i) the flow is cooled in a heat exchanger and separated in a distillation column or a separator vessel, ii) a liquid flow containing at least 99 mol % of carbon dioxide is withdrawn at the bottom of the column or vessel, and iii) at least a portion of the liquid flow is sent to be cooled in the heat exchanger to form a subcooled liquid, iv) at least a portion of the subcooled liquid is expanded to produce a two-phase flow, v) the two-phase flow is separated to form a gas and a liquid and at least a portion of the liquid is sent to be heated in the heat exchanger by indirect heat exchange with at least a portion of the flow that is to be separated and with the at least a portion of the liquid that is to be subcooled, the at least a portion of the liquid vaporizing in the heat exchanger and vi)

a) according to the first mode of operation, a') a portion of the liquid from step v) is taken as first liquid product (4), or b') a portion of the subcooled liquid is taken as first liquid product and b) according to the second mode of operation, a portion (5) of the bottom liquid is taken as second liquid product without subcooling it in the heat exchanger, no portion of the liquid from step v) is taken as first liquid product, all of the liquid from step v) being vaporized in the heat exchanger, and no portion of the subcooled liquid is taken as the first liquid product.

According to other optional aspects:

the liquid product is at between 6 and 8 bara a portion of the liquid flow is taken without subcooling it to form a product at between 10 and 40 bara, preferably between 13 and 20 bara.

a common pump is used to bring, during the first operating mode, the portion of the subcooled liquid or a portion of the liquid from step v) to its final pressure to form the first product and, during the second mode of operation, the portion of the bottom liquid not cooled in the heat exchanger to its final pressure to form the second product.

According to another object of the invention, there is provided an apparatus for the separation of a flow containing at least 95 mol % of carbon dioxide and also at least one impurity lighter than carbon dioxide by distillation comprising a heat exchanger (20), a distillation column (30) or a separator vessel, expansion means (V3), means for sending the flow to be cooled in the heat exchanger, means for sending the cooled flow to be separated in the distillation column or in the vessel, means for withdrawing at the bottom of the column or vessel a liquid flow containing at least 99 mol % of carbon dioxide, means for sending at least a portion (12) of the liquid flow to be cooled in the heat exchanger to form a subcooled liquid (3), means for sending at least a portion of the subcooled liquid to the expansion means to produce a two-phase flow, a phase separator (40) for separating the two-phase flow to form a gas and a liquid, means for sending at least a portion (14) of the liquid from the phase separator to be heated in the heat exchanger by indirect heat exchange with at least a portion of the flow that is to be separated and with the at least a portion of the liquid that is to be subcooled, means for taking a portion (4) of the liquid from the phase separator or of the subcooled liquid as liquid product at a first pressure and means for supplying liquid which has not been subcooled as liquid product at a second pressure connected to the means for withdrawing a liquid flow at the bottom of the column or vessel.

According to other optional aspects:

the apparatus comprises means for sending liquid from the phase separator vaporized in the heat exchanger to be mixed with the flow that is to be separated upstream of the heat exchanger.

the heat exchanger has two ends, one designed to operate at a hotter temperature than the other, the means for sending the flow that is to be separated to be cooled in the exchanger being connected to the end designed to operate at the hotter temperature and the means for sending the cooled flow to be separated in the distillation column or in the vessel being connected to the end designed to operate at the colder temperature.

the heat exchanger has two ends, one designed to operate at a hotter temperature than the other, the means for sending at least a portion of the liquid flow to be cooled in the heat exchanger to form a subcooled liquid being connected to the end designed to operate at the colder temperature.

the heat exchanger has two ends, one designed to operate at a hotter temperature than the other, the means for sending at least a portion of the liquid from the phase separator to be heated in the heat exchanger being connected to the end designed to operate at the colder temperature.

the heat exchanger has two ends, the one designed to operate at a hotter temperature than the other comprising means for discharging the liquid from the phase separator vaporized in the heat exchanger from the end designed to operate at the hotter temperature.

the apparatus comprises means for sending liquid from the phase separator vaporized in the heat exchanger to be mixed with the flow that is to be separated upstream of the heat exchanger.

the apparatus comprises a common pump (55) for bringing:

during the first period, the portion of the subcooled liquid or a portion of the liquid from step v) to its final pressure to form the first product and, during the second period, the portion of the bottom liquid not cooled in the heat exchanger to its final pressure to form the second product.

Thus, the liquid product and the vaporized liquid are initially cooled together in the same passage(s) of the heat exchanger.

The distillation column can comprise structured packings or trays.

The apparatus can comprise a pump downstream of the phase separator.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments FIG. 1 illustrates a process according to an embodiment of the invention.

FIG. 2 illustrates a process according to another embodiment of the invention.

FIG. 3 illustrates a process according to another embodiment of the invention.

DETAILED DESCRIPTION OF THE INVENTION

In [FIG. 1], the flow 1 containing at least 95 mol % of carbon dioxide also contains at least one other impurity, such as oxygen, nitrogen, argon or carbon monoxide. The flow 1 is compressed in a compressor 10 to a first pressure higher than that of the column 30 to form a compressed flow 2 at a first pressure. The lines connecting the compressor 10 and the exchanger 20 are dotted because if the flow is already pressurized the compressor 10 will not be necessary.

The first pressure is greater by at least 1 bar than that of the column 30, preferably by at least 10 bara, or even at least 20, 30 or 40 bar greater than that of the column 30. For example, the first pressure can be at least 35 bara. In some cases, the pressure of the column can be 40 bara.

The compressed flow 2 is cooled in the indirect-exchange heat exchanger 20 to form a cooled and liquefied flow at the first pressure. The cooled and liquefied flow is divided into two portions 4, 6 in the heat exchanger. The portion 4 exits the heat exchanger 20 at an intermediate temperature T1 of the latter without having been expanded upstream of the dividing point.

The two fractions 4, 6 are at the first pressure greater by at least 1 bar than that of the column.

The second fraction 6 continues its cooling up to the cold end of the heat exchanger 20 in order to subcool it in the main heat exchanger down to a minimum temperature close to the triple point of $CO_2$. It is subsequently expanded to the pressure of the column 30 in the valve V2 and sent as liquid flow to the top of the distillation column 30. The column is a single column, not having an overhead condenser. It contains structured packings or trays and operates at a second pressure lower than the first pressure.

The first fraction 4 is sent to the column 30 after expansion from the first pressure to the pressure of the column 30 in the valve V1.

The bottom liquid from the column 30 contains at least 99 mol % of carbon dioxide and is divided into two portions. A portion 5 at the pressure of the column 30 serves as liquid product rich in carbon dioxide. A portion 12 is sent to an intermediate level of the exchanger 20 at a temperature lower than that at which the flow 4 leaves the exchanger. The portion 12 is subcooled in the exchanger 20 up to the cold end and then divided into two. A fraction 3 is expanded in the valve V3 to form a two-phase flow separated in a phase separator 40. The gaseous portion 16 is heated in the exchanger 20 and is sent to the compressor 10. The liquid portion 14 is vaporized and heated in the heat exchanger 20 from the cold end up to the hot end. It can be divided into several portions which are expanded to different pressures, introduced at the cold end or at an intermediate point of the heat exchanger 20 and vaporized at different pressures, in order to optimize the heat exchange.

The vaporization pressure of the flow 14 can be greater than, equal to or lower than the pressure of the flow 1 to be treated. Thus, in this case, the vaporized flow 18 is sent to an intermediate level of the compressor 10.

The fraction 4 of the subcooled liquid 12 is expanded in a valve V4 to bring it to a pressure lower than that of the liquid 5.

The overhead gas 11 from the column contains at least one impurity lighter than carbon dioxide, such as oxygen, nitrogen and argon. It can be heated in the heat exchanger 20.

The absence of a column K overhead condenser, the absence of a separator vessel for the overhead gas and the fact that the scheme does not comprise a pump, apart possibly from a product pump, are noted.

In this example, the liquid 5 is sent to storage at a pressure between 10 and 40 bara, for example between 13 and 20 bara, constituting the medium-pressure product, and the liquid 4 at between 6 and 8 bara constitutes the low-pressure product.

The column 30 operates at at least 10 bara, preferably between 10 and 40 bara, for example between 13 and 20 bara.

It will be understood that the flow 5 is not necessarily present or is not necessarily withdrawn continuously.

As a variant, illustrated in [FIG. 2], the product 8 can be derived from the liquid from the phase separator 40. Thus, all of the subcooled liquid 12 is expanded in a valve V3 to form a two-phase mixture. This mixture is separated in a phase separator 40, the gas being heated as for [FIG. 1]; the liquid 8 is divided into two fractions, one 50 being vaporized in the heat exchanger and the remainder 4 being pressurized in a pump P to form a product. In this case, the liquid 4 can be produced at a pressure greater than, less than or equal to that of the product 5.

In particular, the liquid 5 can be sent to storage at a pressure between 10 and 40 bara, for example between 13 and 20 bara, constituting the medium-pressure product, and the liquid 4 at between 6 and 8 bara constitutes the low-pressure product. The phase separator will have to be at a pressure between the pressure required of low-pressure storage pressure, i.e. between 5.5 bara and 8 bara for storage at 7 bara, thus it is necessary to use the pump P to reach the storage pressure in particular in the case where the installation constraints make it necessary to install the storage means at a long distance from the liquefier.

The invention can make it possible to modify the configuration of the prior art liquefiers so that they can produce $CO_2$ in different modes and in an optimized manner:

production at medium production only, production at low production only, or production at both pressures simultaneously.

In order to allow the modes with low-pressure production, the liquefier must be dimensioned for the production at low production only because this is the most constraining case with respect to the subcooling of the production flow. The energy required for this is provided by the vaporization of liquid $CO_2$ at low pressure, the vapor generated being sent to the cycle compressor as illustrated in [FIG. 1]:

the vaporization of this $CO_2$ additionally makes it possible to cool the liquid $CO_2$ used as reflux of the distillation column.

this vaporized low-pressure $CO_2$ comes from the bottom of the distillation column, is subcooled before being expanded and injected into the heat exchanger.

The invention mainly consists in the sharing of the subcooling pass from the bottom of the distillation column to the cold end of the exchanger for the production $CO_2$ and the cycle $CO_2$. This makes it possible to avoid a "dry" pass in the event of production at medium pressure only. In liquid production mode at low pressure only or partially, this pass will process the cycle $CO_2$ and also the production $CO_2$ to be subcooled. In production mode at medium pressure only, this pass will only involve the cycle $CO_2$ to be subcooled.

In order to allow the production of $CO_2$ at medium pressure, a line coming directly from the bottom of the distillation column is provided in parallel with the subcooling pass. In this case, the amount of cold at low temperature is reduced, since the share of $CO_2$ needing to be subcooled (low pressure production or cycle) is reduced.

Another variant in [FIG. 2] consists in sharing the expansion valves and a separation vessel in addition to the subcooling pass. Specifically, a gas phase will be generated by low-pressure expansion of the cycle $CO_2$. A vessel 40 is used jointly in order to separate the gas phase and the liquid phase before introduction into the exchanger. The generated liquid phase 8 can then be partly used also as production at low pressure. This allows the use of a single vessel to separate the gas of the liquid of the cycle $CO_2$ from that of the production. If the pressure of the cycle $CO_2$ is too low compared to that required for the production, a pump 50 will then be necessary to increase the pressure of the production to its storage pressure.

The figures represented here show the flow to be separated as being separated into two portions, one portion being cooled to a first temperature and sent to the column and the remainder being cooled up to the cold end of the exchanger and sent to the top of the column. It will be understood that the invention is not necessarily bound to this provision and that therefore the column can be fed in any manner.

In addition, the overhead gas 11 may or may not be heated in the exchanger: the same is true for the gas 16.

In the examples, a distillation column is described for conducting the separation. It will be understood that at least one separator vessel can replace the column or be arranged upstream of the column. In this case, the vessel would be fed by the flow 4, the flow 6 not existing. The liquid in the vessel would be divided into two portions to form the flows 5, 12.

The gas 11 from the vessel would be sent to the atmosphere or heated in the exchanger 20.

It will be understood that the flow 5 is not necessarily present or is not necessarily withdrawn continuously.

FIG. 3 shows a variant of the previous figures where the process makes it possible to produce a single liquid rich in carbon dioxide with a single pump but with the choice of two different pressures.

In certain cases, in particular when the column 30 operates at a lower pressure than that of the product at higher pressure, the flow 5 must be pumped in order to obtain a sufficient pressure on arrival at the storage. This is also true when, for installation- or bulk-related constraints, the storage means are installed at a certain distance from the liquefier.

In these cases, a pump 55 is installed on the stream 5.

The apparatus comprises a single pump 55 for liquid rich in carbon dioxide which can be fed alternately by one of two flows at two different pressures.

If it is desired to produce liquid at a higher pressure, the valve V4 is closed and the valve V5 is opened. All of the liquid from the phase separator 40 is sent to vaporize in the exchanger 20. The bottom liquid 5 of the column is sent to the pump 55 at the pressure of the column 30 and is pumped to form a liquid 45 at a higher pressure.

If it is desired to produce liquid at a lower pressure, the valve V4 is opened and the valve V5 is closed. A portion 14 of the liquid from the phase separator 40 is sent to vaporize in the exchanger 20. The remainder 4 of the liquid passes through the valve V4 and arrives at the inlet of the pump 55 at a pressure lower than that of the column 30 and is pumped to form a liquid 45 at a lower pressure. Since the valve V5 is closed, the liquid 5 is not sent to the pump 55.

The pump 55 must therefore adapt to pressurizing the liquid from two different pressures to produce the liquid 45 at two different pressures.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for the separation of a flow (1, 2) containing at least 95 mol % of carbon dioxide and also at least one impurity lighter than carbon dioxide by distillation, wherein:

i) cooling the flow in a heat exchanger (20) and separated in a distillation column (30) or by a partial condensation step in a separator vessel;

ii) withdrawing a liquid flow containing at least 99 mol % of carbon dioxide at the bottom of the column or vessel;

iii) sending a portion (12) of the liquid flow to be cooled in the heat exchanger to form a subcooled liquid;

iv) expanding at least a portion of the subcooled liquid to produce a two-phase flow;

v) separating the two-phase flow to form a gas and a liquid and sending at least a portion of the liquid (14) to be heated in the heat exchanger by indirect heat exchange with at least a portion of the flow that is to be separated and with the at least a portion of the liquid that is to be subcooled, the at least a portion of the liquid vaporizing in the heat exchanger;

vi) producing a first liquid product by: (a) taking a portion (4) of the liquid (8) from step v), optionally after pressurization in a pump (50, 55) or (b) taking a portion (4) of the subcooled liquid;

vii) producing a second liquid product (5) by taking a portion of the bottom liquid from the column or vessel without cooling the portion of the bottom liquid in the heat exchanger (20) and preferably without expanding the portion of the bottom liquid; and viii) producing the first liquid product and the second liquid product (4, 5) are produced simultaneously.

2. The process as claimed in claim 1, with variant vi) (a), wherein all of the subcooled liquid (3) is expanded to produce the two-phase flow and a portion of the liquid (14) from step v) is sent to be vaporized in the heat exchanger (20).

3. The process as claimed in claim 1, with variant vi) (b), wherein a portion (3) of the subcooled liquid is expanded to produce the two-phase flow and all of the liquid (14) from step v) is sent to be vaporized in the heat exchanger (20).

4. The process as claimed in claim 1, wherein the gas (16) from step v) is heated in the exchanger (20).

5. The process as claimed in claim 1, wherein the liquid vaporized (18) in the exchanger (20) is sent to be mixed with the flow that is to be cooled (2) upstream of the exchanger.

6. A process for the separation of a flow containing at least 95 mol % of carbon dioxide and also at least one impurity lighter than carbon dioxide by distillation, wherein according to a first and a second mode of operation:

cooling the flow in a heat exchanger (20) and separated in a distillation column (30) or a separator vessel;

ii) withdrawing a liquid flow containing at least 99 mol % of carbon dioxide at the bottom of the column or vessel; and iii) sending at least a portion (12) of the liquid flow to be cooled in the heat exchanger to form a subcooled liquid (3);

iv) expanding at least a portion of the subcooled liquid to produce a two-phase flow;

v) the two-phase flow is separated to form a gas (16) and a liquid (8, 14) and at least a portion (14) of the liquid is sent to be heated in the heat exchanger by indirect heat exchange with at least a portion of the flow that is to be separated and with the at least a portion of the liquid that is to be subcooled, the at least a portion of the liquid vaporizing in the heat exchanger; and vi) wherein a) according to the first mode of operation, a') a portion of the liquid from step v) is taken as first liquid product (4), or b') a portion of the subcooled liquid is taken as first liquid product and b) according to the second mode of operation, a portion (5) of the bottom liquid is taken as second liquid product without subcooling it in the heat exchanger, no portion of the liquid from step v) is taken as first liquid product, all of the liquid from step v) being vaporized in the heat exchanger, and no portion of the subcooled liquid is taken as the first liquid product.

7. The process as claimed in claim 6, wherein the liquid product (4) is at between 6 and 8 bara and/or a portion of the liquid flow is taken without subcooling it to form a product (5) at between 10 and 40 bara, preferably between 13 and 20 bara.

8. The process as claimed in claim 6, wherein a common pump (55) is used to bring, a) during the first mode, the portion of the subcooled liquid or a portion of the liquid from step v) to its final pressure to form the first product and, b) during the second mode, the portion of the bottom liquid not cooled in the heat exchanger to its final pressure to form the second product.

9. An apparatus for the separation of a flow containing at least 95 mol % of carbon dioxide and also at least one impurity lighter than carbon dioxide by distillation comprising:

a heat exchanger (20);

a distillation column (30) or a separator vessel;

expansion means (V3);

means for sending the flow to be cooled in the heat exchanger;

means for sending the cooled flow to be separated in the distillation column or in the vessel;

means for withdrawing at the bottom of the column or vessel a liquid flow containing at least 99 mol % of carbon dioxide;

means for sending at least a portion (12) of the liquid flow to be cooled in the heat exchanger to form a subcooled liquid (3);

means for sending at least a portion of the subcooled liquid to the expansion means to produce a two-phase flow;

a phase separator (40) for separating the two-phase flow to form a gas and a liquid;

means for sending at least a portion (14) of the liquid from the phase separator to be heated in the heat exchanger by indirect heat exchange with at least a portion of the flow that is to be separated and with the at least a portion of the liquid that is to be subcooled;

means for taking a portion (4) of the liquid from the phase separator or of the subcooled liquid as liquid product at a first pressure; and means for supplying liquid that has not been subcooled as liquid product at a second pressure connected to the means for withdrawing a liquid flow at the bottom of the column or vessel.

10. The apparatus as claimed in claim 9, further comprising means for sending liquid from the phase separator vaporized in the heat exchanger (20) to be mixed with the flow that is to be separated (1) upstream of the heat exchanger.

11. The apparatus as claimed in claim 9, wherein the heat exchanger (20) has two ends, one designed to operate at a hotter temperature than the other, the means for sending the flow that is to be separated (1) to be cooled in the exchanger being connected to the end designed to operate at the hotter temperature and the means for sending the cooled flow (4, 6) to be separated in the distillation column or in the vessel being connected to the end designed to operate at the colder temperature.

12. The apparatus as claimed in claim 9, wherein the heat exchanger (20) has two ends, one designed to operate at a hotter temperature than the other, the means for sending at least a portion (12) of the liquid flow to be cooled in the heat exchanger to form a subcooled liquid (3) being connected to the end designed to operate at the colder temperature.

13. The apparatus as claimed in claim 9, wherein the heat exchanger (20) has two ends, one designed to operate at a hotter temperature than the other, the means for sending at least a portion (14) of the liquid from the phase separator to be heated in the heat exchanger being connected to the end designed to operate at the colder temperature.

14. The apparatus as claimed in claim 9, wherein the heat exchanger (20) has two ends, the one designed to operate at a hotter temperature than the other comprising means for discharging the liquid from the phase separator vaporized in the heat exchanger from the end designed to operate at the hotter temperature.

15. The apparatus as claimed in claim 9, further comprising a pump (55) configured to bring, (a) during a first period, the portion of the subcooled liquid or a portion of the liquid form the phase separator to its final pressure to form a first product and, (b) during a second period the portion of the liquid flow from the bottom of the column or vessel that has not been subcooled to its final pressure to form the second product.

* * * * *